US008192157B2

(12) United States Patent
Horng

(10) Patent No.: US 8,192,157 B2
(45) Date of Patent: Jun. 5, 2012

(54) FAN FRAME STRUCTURE

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 730 days.

(21) Appl. No.: 12/344,646

(22) Filed: Dec. 29, 2008

(65) Prior Publication Data

US 2009/0169377 A1 Jul. 2, 2009

Related U.S. Application Data

(63) Continuation-in-part of application No. 12/003,530, filed on Dec. 28, 2007.

(30) Foreign Application Priority Data

Dec. 2, 2008 (TW) ..... 97146744 A

(51) Int. Cl.
*F04D 29/24* (2006.01)

(52) U.S. Cl. ..... 415/203; 415/200

(58) Field of Classification Search ..... 415/203, 415/213.1, 208.1, 200; 416/189
See application file for complete search history.

(56) References Cited

U.S. PATENT DOCUMENTS

| | | | | |
|---|---|---|---|---|
| 6,406,258 | B1 | 6/2002 | Lin et al. | |
| 6,565,326 | B2 | 5/2003 | Horng et al. | |
| 6,724,106 | B1 | 4/2004 | Horng et al. | |
| 7,140,837 | B2 * | 11/2006 | Ku et al. | 415/121.2 |
| 2006/0013686 | A1 | 1/2006 | Ku et al. | |
| 2009/0290975 | A1 * | 11/2009 | Li | 415/111 |

* cited by examiner

*Primary Examiner* — Caridad Everhart
(74) *Attorney, Agent, or Firm* — Alan Kamrath; Kamrath IP Lawfirm, PA

(57) ABSTRACT

A fan frame structure includes a plastic casing and a metal fixing frame. The plastic casing and the metal fixing frame are provided for an axial flow fan or a blower fan. The plastic casing includes a bottom having a plurality of first fixing portions. The metal fixing frame includes a base with a shaft tube seat in a center thereof. The base includes a plurality of second portions each engaged with one of the first fixing portions. Since the plastic casing is made of inexpensive plastic material, the manufacturing costs are cut. The metal fixing frame provides sufficient structural strength and desired heat dissipating effect.

15 Claims, 10 Drawing Sheets

FAN FRAME STRUCTURE

CROSS REFERENCE TO RELATED APPLICATION

This is a continuation-in-part application of U.S. patent application Ser. No. 12/003,530 filed on Dec. 28, 2007.

BACKGROUND OF THE INVENTION

1. Field of the Invention

The present invention relates to a fan frame structure and, more particularly, to a fan frame structure including a plastic casing and a metal fixing frame.

2. Description of the Related Art

FIG. 1 shows a conventional fan frame structure including a frame 10 having a central accommodation space 11 receiving a bottom base 12. Formed at a center of the bottom base 12 is a shaft tube seat 13, allowing mounting of a fan motor and fan blades to the bottom base 12 in the accommodation space 11. A plurality of support arms 14 are interconnected between the bottom base 12 and an inner periphery of the accommodation space 11. The frame 10 is integrally formed with the bottom base 12.

The conventional fan frame structure is integrally formed by die casting with metal such as aluminum or by injection molding with plastic material. Using metal material results in high costs of the fan frame structure. On the other hand, the support arms 14 of the fan frame structure made of plastic material are fragile and, thus, liable to break, leading to problems in structural strength and quality. Furthermore, new molds for the integrally formed fan frame structure of metal or plastic material are required when the size of the bottom base 12 is changed, although the frames 10 of many fans have the same specification. Furthermore, conventional fan frames have various specifications to meet the requirements of assembly of fan motors of differing powers, leading to problems in inventory management due to various types of products or demand of a large warehouse or space Thus, a need exists for a fan frame structure that can be manufactured at low costs while allowing easy inventory management, saving the costs for molds, and enhancing the quality.

SUMMARY OF THE INVENTION

The present invention solves this need and other problems in the field of fan frame structures by providing a fan frame structure including a plastic casing and a metal fixing frame. The plastic casing and the metal fixing frame are provided for an axial flow fan or a blower fan. A fan frame structure made of different materials is provided for reducing the manufacturing costs, saving the costs for molds, enhancing quality and allowing easy inventory management. Furthermore, the metal fixing frame provides sufficient structural strength and desired heat dissipating effect.

In a preferred form according to a first aspect of the present invention, the plastic casing includes an air inlet in a top side thereof and an air outlet in a bottom side thereof. The plastic casing further includes an accommodation space in communication with the air inlet and the air outlet. The bottom side of the plastic casing further includes a plurality of corners each having a first fixing portion. The metal fixing frame includes a base having a shaft tube seat in a center thereof. The base further includes a plurality of support arms extending outward from an outer periphery thereof. Each support arm has a first end interconnected to the base and a second end forming a second fixing portion engaged with one of the first fixing portions of the plastic casing.

In a most preferred form, each corner of the bottom side of the plastic casing is adjacent to the air outlet and includes a groove. Each groove includes a bottom wall having one of the holes. The second end of each support arm is received in one of the grooves and includes a through-hole aligned with one of the holes of the plastic casing. The fan frame structure further includes a plurality of fasteners each extending through one of the holes of the plastic casing and one of the through-holes of the metal fixing frame to engage the plastic casing and the metal fixing frame together. Thus, the plastic casing and the metal fixing frame can be easily assembled together or detached from each other for maintenance and replacement purposes.

In another most preferred form, each first fixing portion of the plastic casing envelopes one of the second fixing portions of the metal fixing frame by injection molding. Fewer elements are utilized, the engaging reliability is enhanced, and assembly is more convenient. Furthermore, each second fixing portion of the metal fixing frame can include a plurality of trenches, a slot, or a plurality of ribs to effectively avoid disengagement between the plastic casing and the metal fixing frame. Further, an insulating plate can be formed around the shaft tube seat of the base of the metal fixing frame. When a fan motor and blades are mounted to the fan frame structure to form a heat dissipating fan, the insulating plate provides an insulating effect between a stator of the fan motor and the metal fixing frame.

In a preferred form according to a second aspect of the present invention, the plastic casing includes an air inlet in a top side thereof and an air outlet in a lateral side thereof. The plastic casing further includes an accommodation space in communication with the air inlet and the air outlet. The plastic casing further includes a bottom side having a peripheral edge with a plurality of first fixing portions. The metal fixing frame includes a base having a shaft tube seat in a center thereof. The base further includes a perimeter having a plurality of second fixing portions each securely engaged with one of the first fixing portions of the plastic casing.

In a most preferred form, each first fixing portion of the plastic casing envelopes one of the second fixing portions of the metal fixing frame by injection molding. The second fixing portions of the metal fixing frame includes a plurality of notches in the perimeter of the base.

In another most preferred form, the second fixing portions of the metal fixing frame includes a plurality of tabs extending in an axial direction and spaced from each other along the perimeter of the base. Each tab can include a positioning hole or a hooked portion.

In a further most preferred form, an insulating plate can be formed around the shaft tube seat of the base of the metal fixing frame. When a fan motor and blades are mounted to the fan frame structure to form a heat dissipating fan, the insulating plate provides an insulating effect between a stator of the fan motor and the metal fixing frame.

In still another most preferred form, the base of the metal fixing frame further includes a plurality of protrusions surrounding the shaft tube seat, and the plastic casing envelopes the protrusions.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
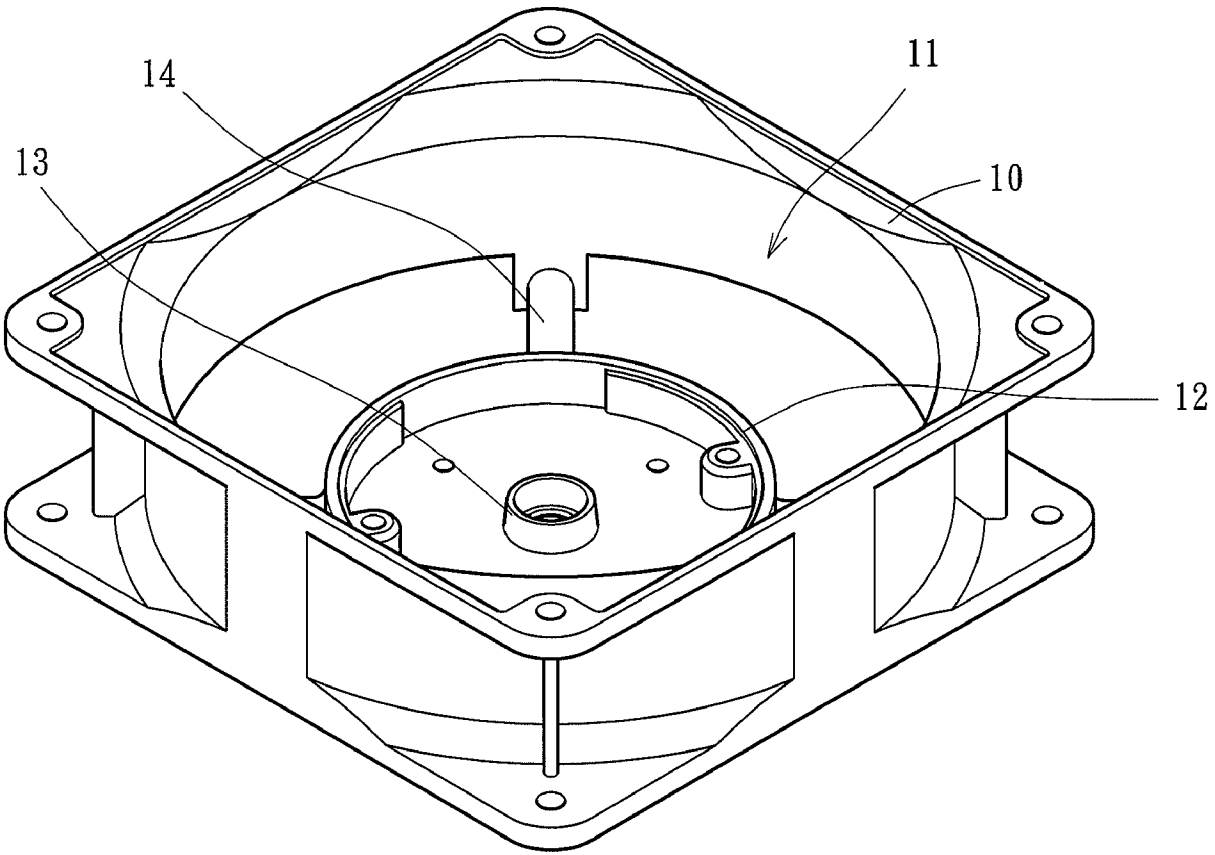
FIG. 1 PRIOR ART
FIG. 1 shows a perspective view of a conventional fan frame structure.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "top", "bottom", "axial", "radial", "lateral", "annular", "outward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
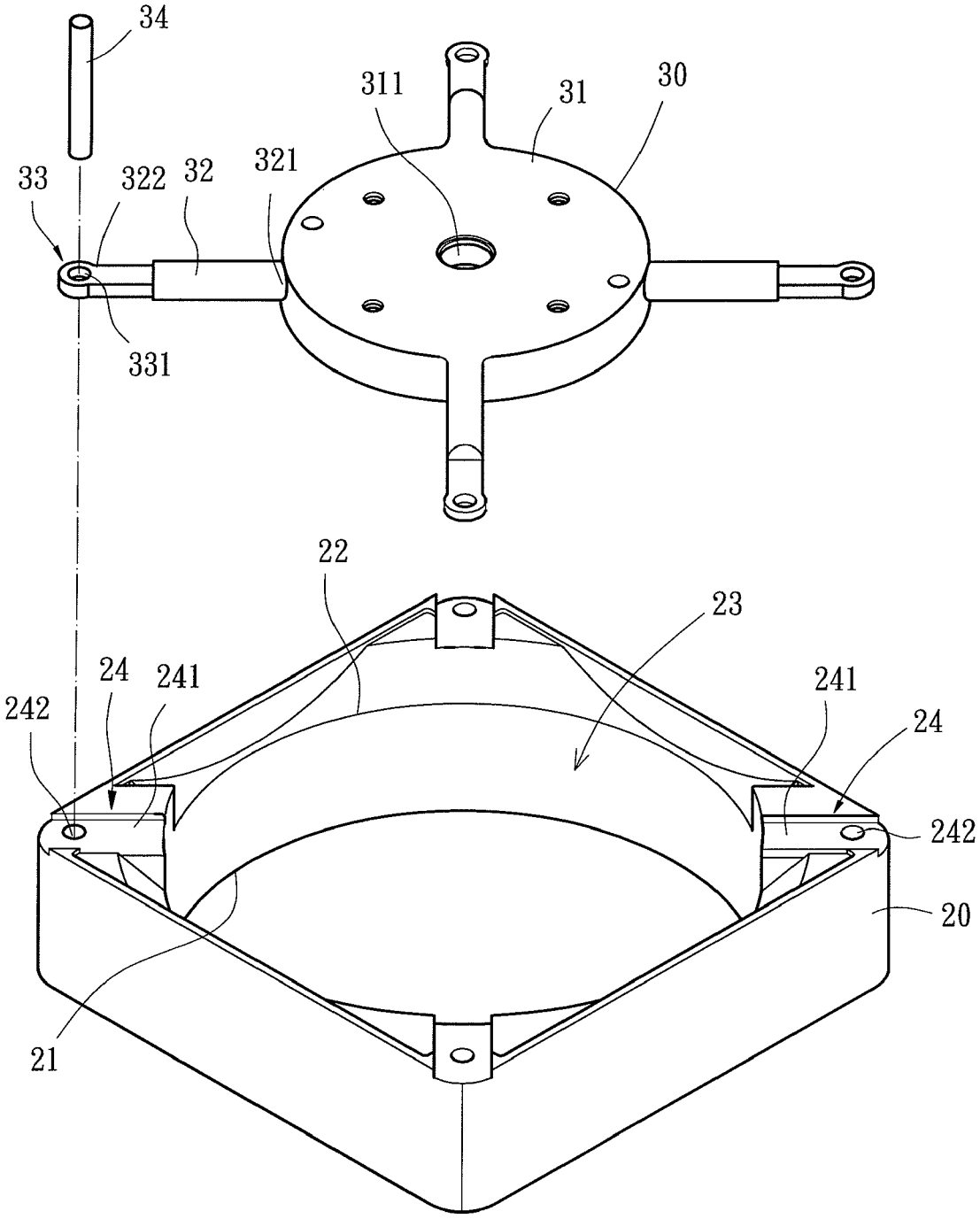
FIG. 2 shows an exploded, perspective view of a fan frame structure of a first embodiment according to the preferred teachings of the present invention.
Figure 3:
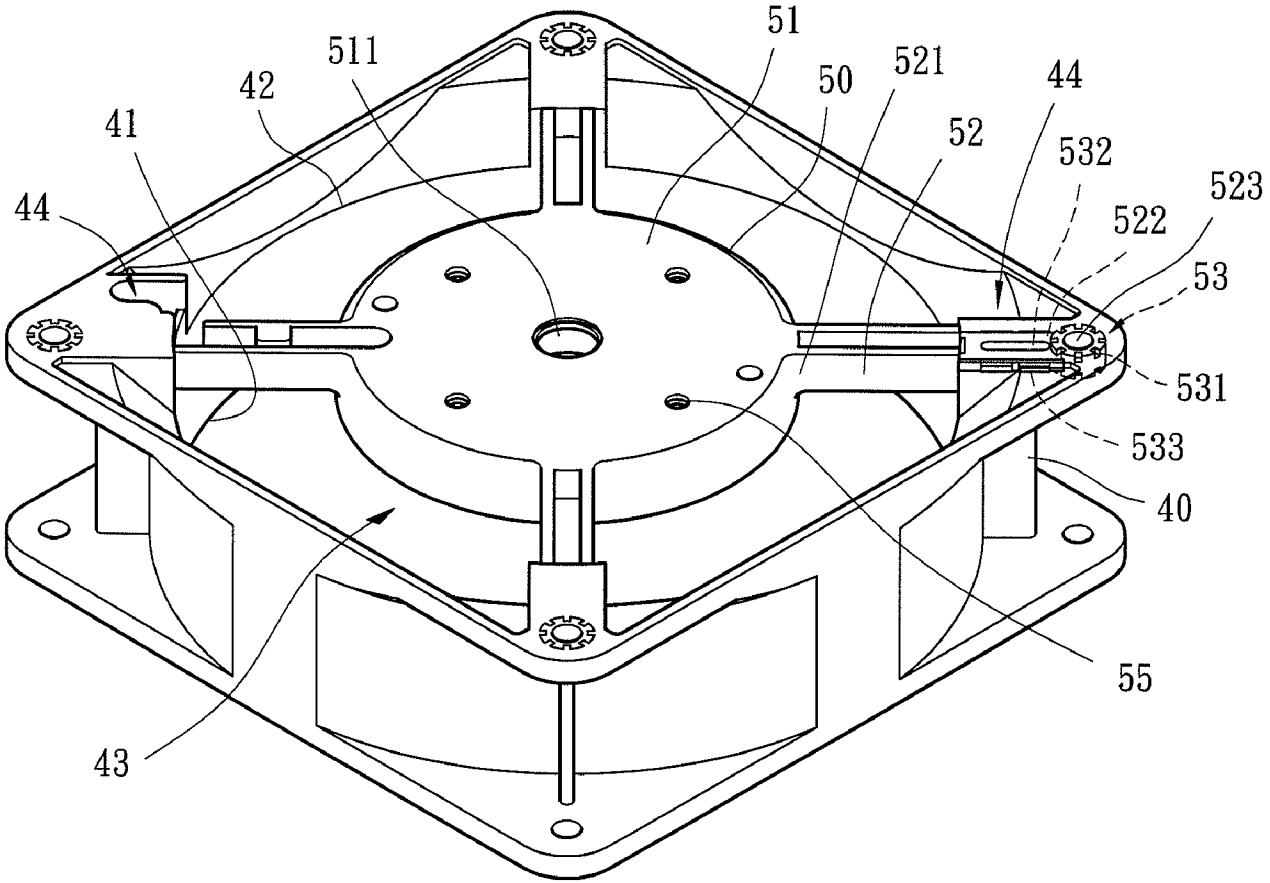
FIG. 3 shows a perspective view of a fan frame structure of a second embodiment according to the preferred teachings of the present invention.
Figure 4:
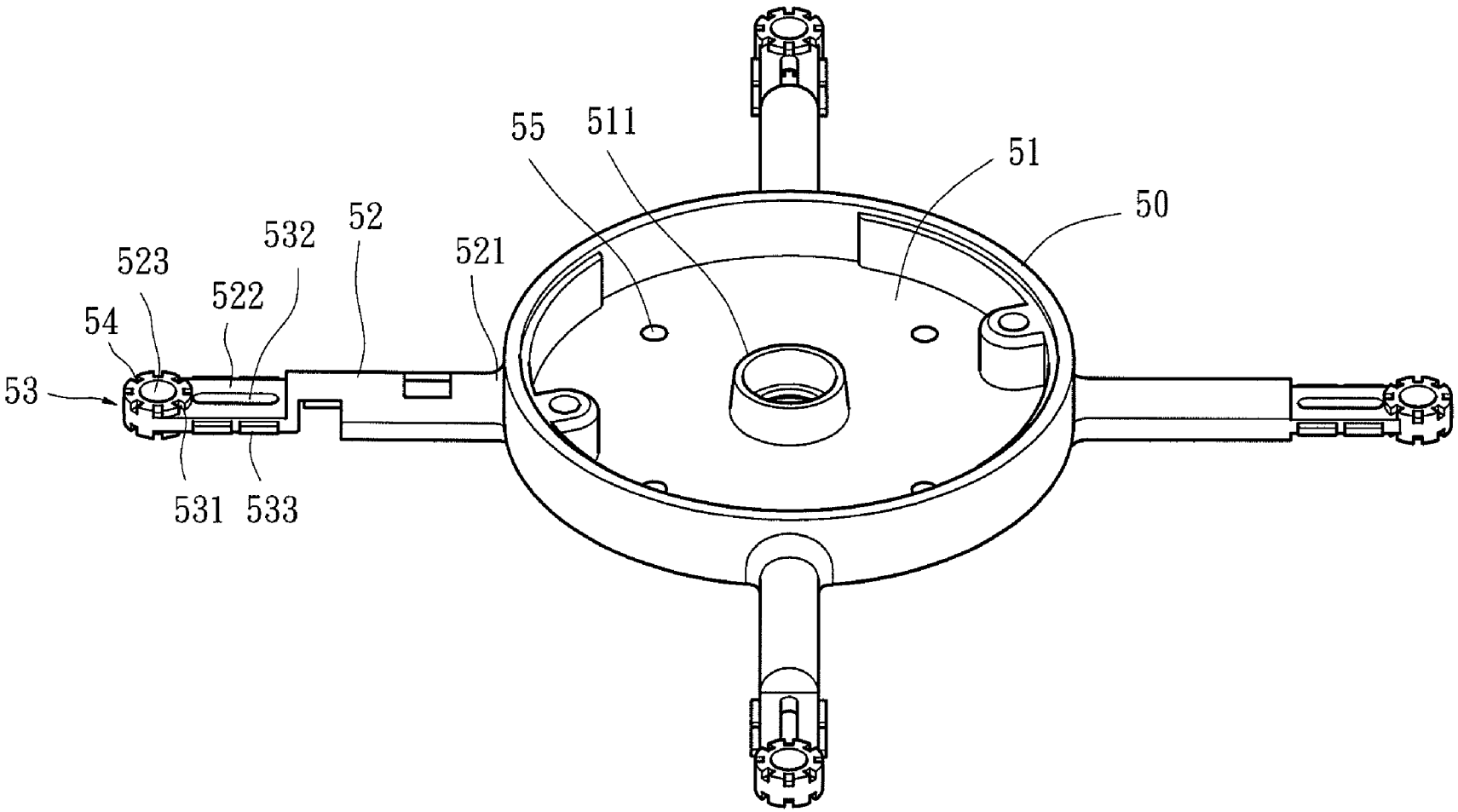
FIG. 4 shows a perspective view of a metal fixing frame of the fan frame structure of FIG. 3.
Figure 5:
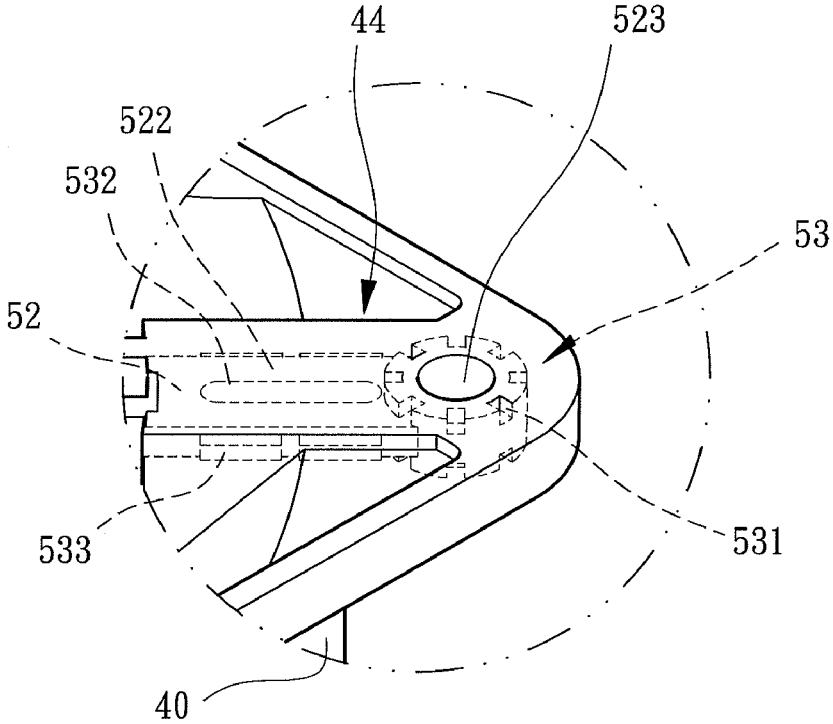
FIG. 5 shows a partial, enlarged, perspective view of the fan frame structure of FIG. 3.
Figure 6:
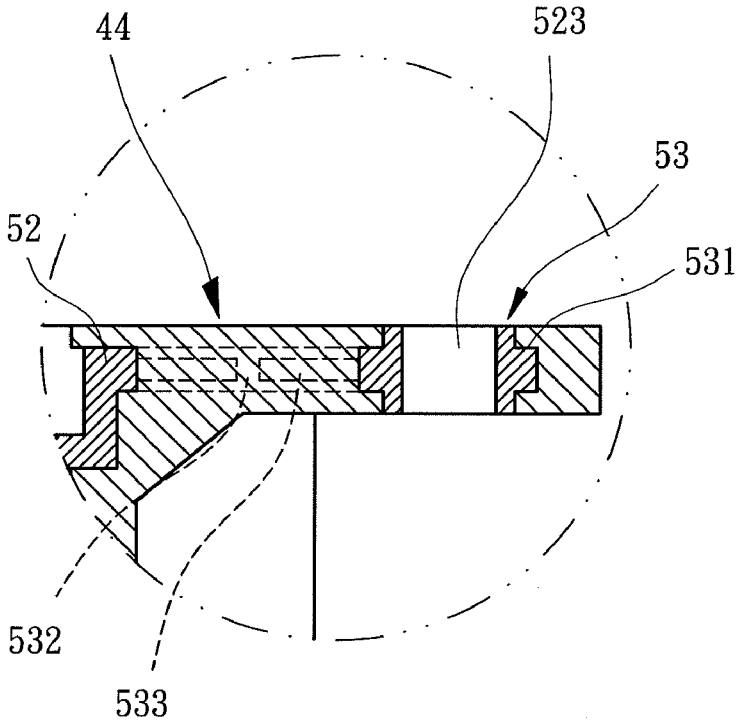
FIG. 6 shows a partial, enlarged, cross sectional view of the fan frame structure of FIG. 3.

A fan frame structure of a first embodiment according to the preferred teachings of the present invention is shown in FIG. 2 of the drawings. According to the preferred form shown, the fan frame structure is provided for an axial flow fan. The fan frame structure includes a plastic casing 20 and a metal fixing frame 30. Specifically, the plastic casing 20 includes an air inlet 21 in a top side thereof and an air outlet 22 in a bottom side thereof parallel to and spaced from the top side. The plastic casing 20 defines an accommodation space 23 in communication with the air inlet 21 and the air outlet 22. The bottom side of the plastic casing 20 includes a plurality of first fixing portions 24 at corners of the plastic casing 20. In the most preferred form shown, each first fixing portion 24 includes a groove 241 in each corner of the bottom side of the plastic casing 20. Each groove 241 includes a bottom wall having a hole 242 that is preferably a through-hole.

According to the preferred form shown, the metal fixing frame 30 includes a base 31 having a shaft tube seat 311 in a center thereof. The shaft tube seat 311 can be in the form of a hole, a tube, or other structure capable of coupling with a shaft. A plurality of support arms 32 extend radially outward from an outer periphery of the base 31. Each support arm 32 includes a first end 321 interconnected to the base 31 and a second end 322 forming a second fixing portion 33 for engaging with one of the first fixing portions 24 of the plastic casing 20 to engage the plastic casing 20 with the metal fixing frame 30. In the most preferred form shown, the second fixing portion 33 formed at the second end 322 of each support arm 32 has a through-hole 331.

In assembly, the second end 322 of each support arm 32 is received in the groove 241 of one of the first fixing portions 24 with the through-hole 331 aligned with the hole 242. A fastener 34 such as a rivet or a screw is extended through each through-hole 331 and one of the holes 242 to fix the plastic casing 20 and the metal fixing frame 30 together. A fan frame structure made of different materials for an axial flow fan is, thus, provided.

FIGS. 3-6 show a fan frame structure of a second embodiment according to the preferred teachings of the present invention. In the preferred form shown, a plastic casing 40 includes an air inlet 41 in a top side thereof and an air outlet 42 in a bottom side thereof. The plastic casing 40 defines an accommodation space 43 in communication with the air inlet 41 and the air outlet 42. The bottom side of the plastic casing 40 includes a plurality of first fixing portions 44 at corners of the plastic casing 40. In the most preferred form shown, the plastic casing 40 is integrally formed by injection molding to form the first fixing portions 44 that envelope predetermined portions of a metal fixing frame 50.

The metal fixing frame 50 includes a base 51 having a shaft tube seat 511 in a center thereof. The shaft tube seat 511 can be in the form of a hole, a tube, or other structure capable of coupling with a shaft. A plurality of support arms 52 extend radially outward from an outer periphery of the base 51. Each support arm 52 includes a first end 521 interconnected to the base 51 and a second end 522 forming a second fixing portion 53. In the most preferred form shown, the second end 522 of each support arm 52 has an assembling hole 523. The second fixing portion 53 formed on the second end 522 of each support arm 52 includes a plurality of trenches 531, a slot 532, and a plurality of ribs 533. It is noted that each support arm 52 can include at least one of the trenches 531, the slot 532, and the ribs 533.

In manufacture, the metal fixing frame 50 is placed in a cavity of a mold, and molten plastic material is then poured into the cavity to form the plastic casing 40, so that the second fixing portions 53 can be enveloped by the first fixing portions 44 of the plastic casing 40. Thus, the plastic casing 40 can securely engage with the second end 522 of each support arm 52 of the metal fixing frame 50 without the risk of disengagement. The trenches 531, the slot 532, and the ribs 533 further prevent the plastic casing 40 from disengaging from the metal fixing frame 50. The assembling hole 523 of each support arm 52 is preferably a through-hole to allow the fan frame structure to be mounted to a desired location for dissipating heat. A fan frame structure made of different materials for an axial flow fan is, thus, provided. It is noted that the fasteners 34 in the first embodiment are not required in the second embodiment. The number of the elements is fewer, the engaging reliability is enhanced, and assembly is more convenient.

Figure 15:
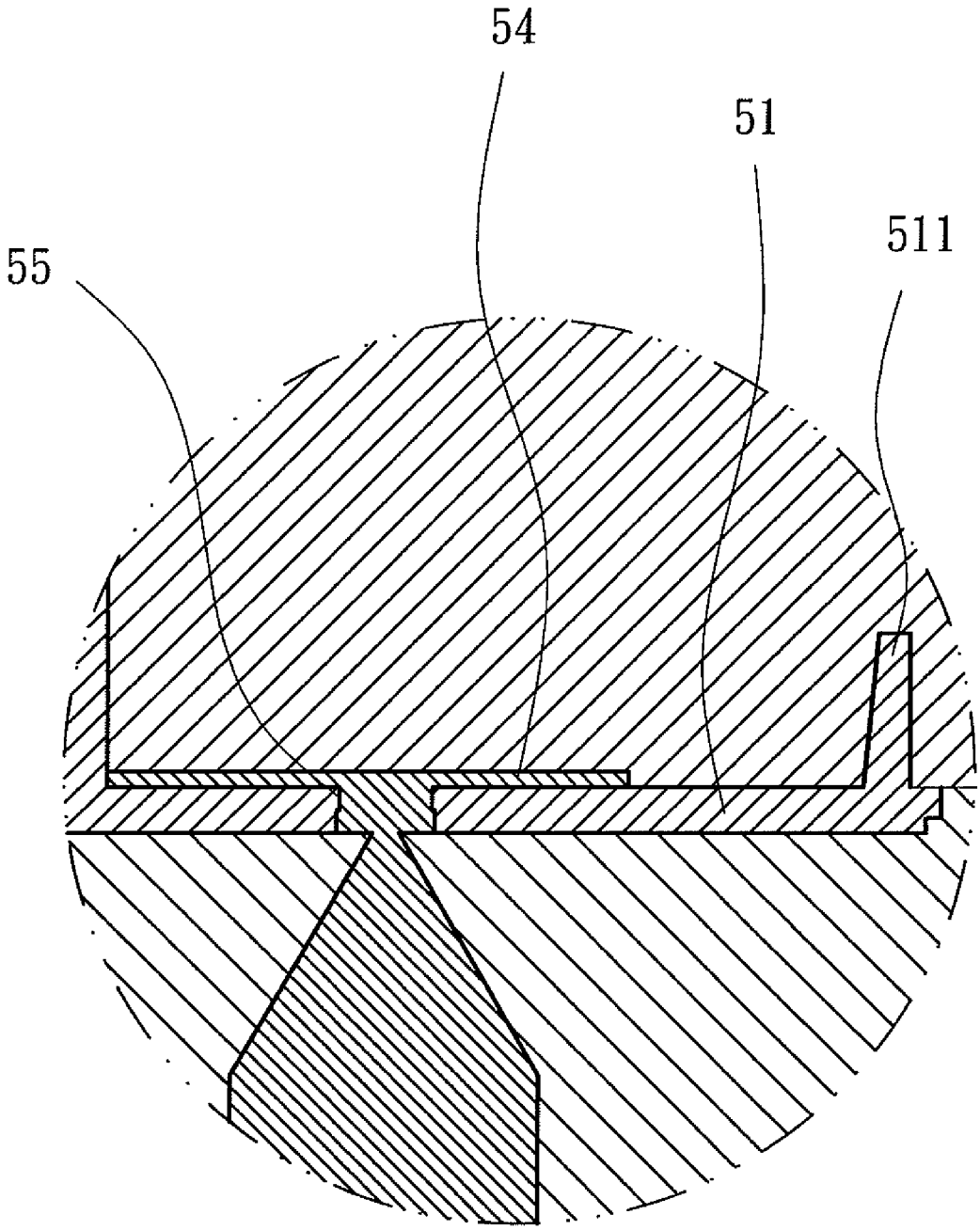
FIG. 15 shows a partial, cross sectional view of a further example modified from the fan frame structure of FIG. 3.

It can be appreciated that an insulating plate 54 (FIG. 15) can be formed around the shaft tube seat 511 during injection molding. The base 51 includes a plurality of feeding holes 55 in the most preferred form shown as stepped holes surrounding the shaft tube seat 511. After removal of the mold, the insulating plate 54 is securely retained around the shaft tube seat 511 by the plastic material filled in the feeding holes 55 that is integral with the plastic material forming the insulating plate 54. When a fan motor and blades are mounted to the fan frame structure to form a heat dissipating fan, the insulating plate 54 provides an insulating effect between a stator of the fan motor and the metal fixing frame 50.

Figure 7:
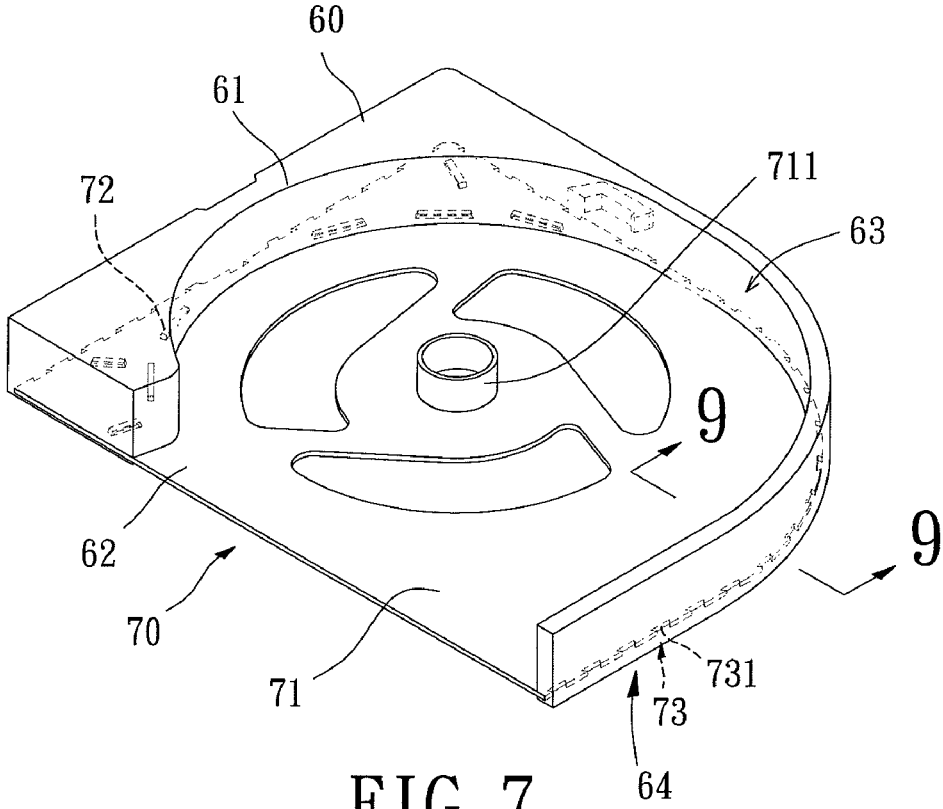
FIG. 7 shows a perspective view of a fan frame structure of a third embodiment according to the preferred teachings of the present invention.
Figure 8:
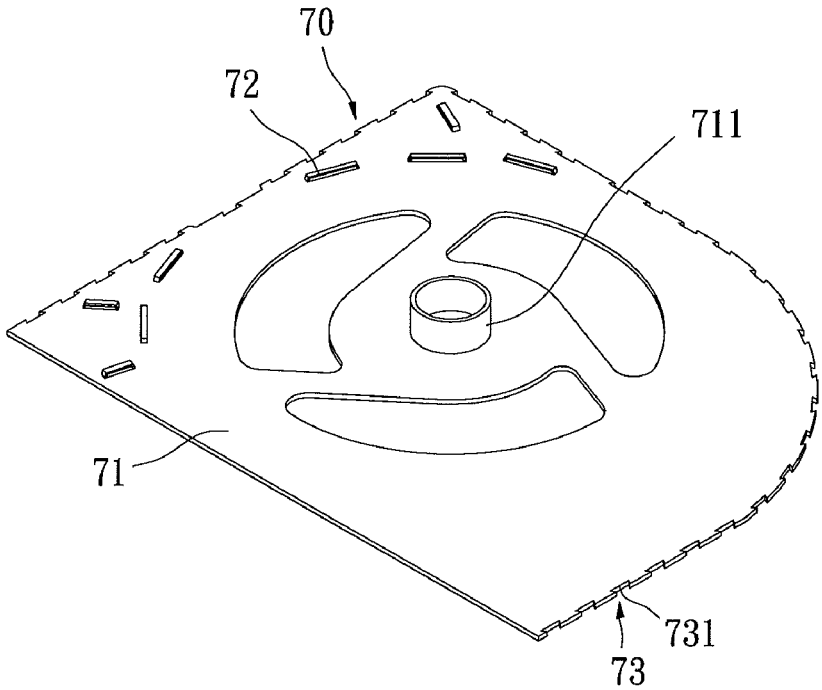
FIG. 8 shows a perspective view of a metal fixing frame of the fan frame structure of FIG. 7.
Figure 9:
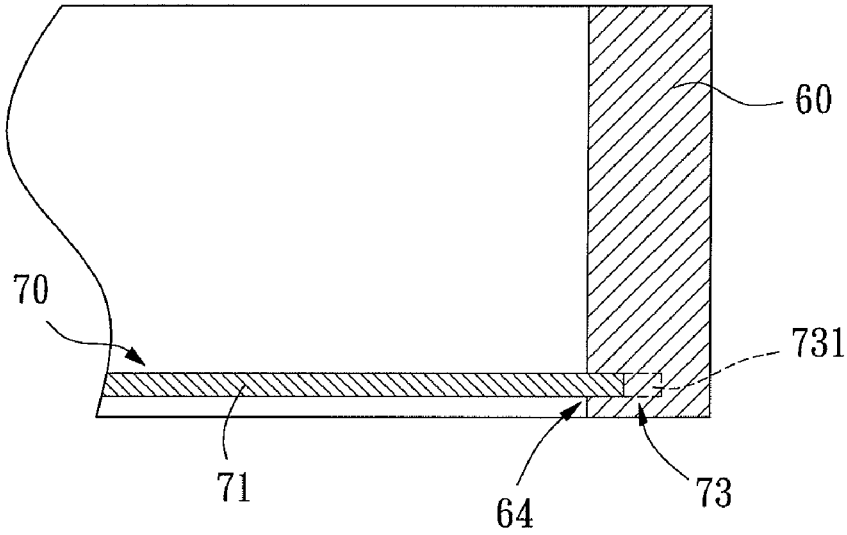
FIG. 9 shows a partial, cross sectional view of the fan frame structure of FIG. 7.

FIGS. 7-9 show a fan frame structure of a third embodiment according to the preferred teachings of the present invention. In the preferred form shown, the fan frame structure is provided for a blower fan and includes a plastic casing 60 and a metal fixing frame 70. In the preferred form shown, the plastic casing 60 includes an air inlet 61 in a top side thereof and an air outlet 62 in a lateral side thereof perpendicular to the top side. The plastic casing 60 defines an accommodation space 63 in communication with the air inlet 61 and the air outlet 62. A bottom side of the plastic casing 60 includes a peripheral edge having a plurality of first fixing portions 64. In the most preferred form shown, the plastic casing 60 is integrally formed by injection molding to form the first fixing portions 64 enveloping predetermined portions of the metal fixing frame 70.

According to the preferred form shown, the metal fixing frame 70 includes a base 71 having a shaft tube seat 711 in a center thereof. The base 71 further includes a plurality of protrusions 72 surrounding the shaft tube seat 711. The base 71 further includes a perimeter having a plurality of second fixing portions 73 for engaging with the first fixing portions 64 of the plastic casing 60, so that the plastic casing 60 and the metal fixing frame 70 can be fixed together. In the most preferred form shown, the second fixing portions 73 include a plurality of notches 731 in the perimeter of the base 71.

In manufacture, the metal fixing frame 70 is placed in a cavity of a mold, and molten plastic material is then poured into the cavity to form the plastic casing 60, so that the second fixing portions 73 can be enveloped by the first fixing portions 64 of the plastic casing 60. Thus, the plastic casing 60 can securely engage with the metal fixing frame 70 without the risk of disengagement by provision of the notches 731. The plastic material of the plastic casing 60 also bonds with the protrusions 72 to further enhance the bonding strength between the plastic casing 60 and the metal fixing frame 70. A fan frame structure made of different materials for a blower fan is, thus, provided.

Figure 10:
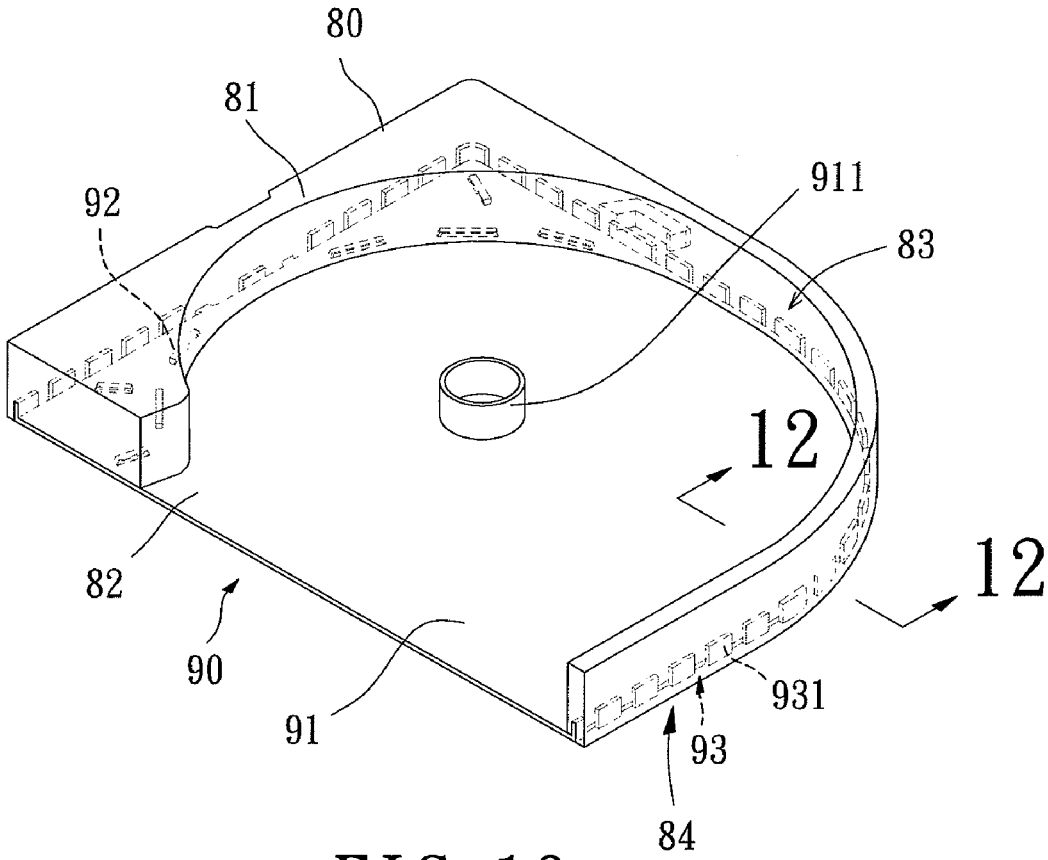
FIG. 10 shows a perspective view of a fan frame structure of a fourth embodiment according to the preferred teachings of the present invention.
Figure 11:
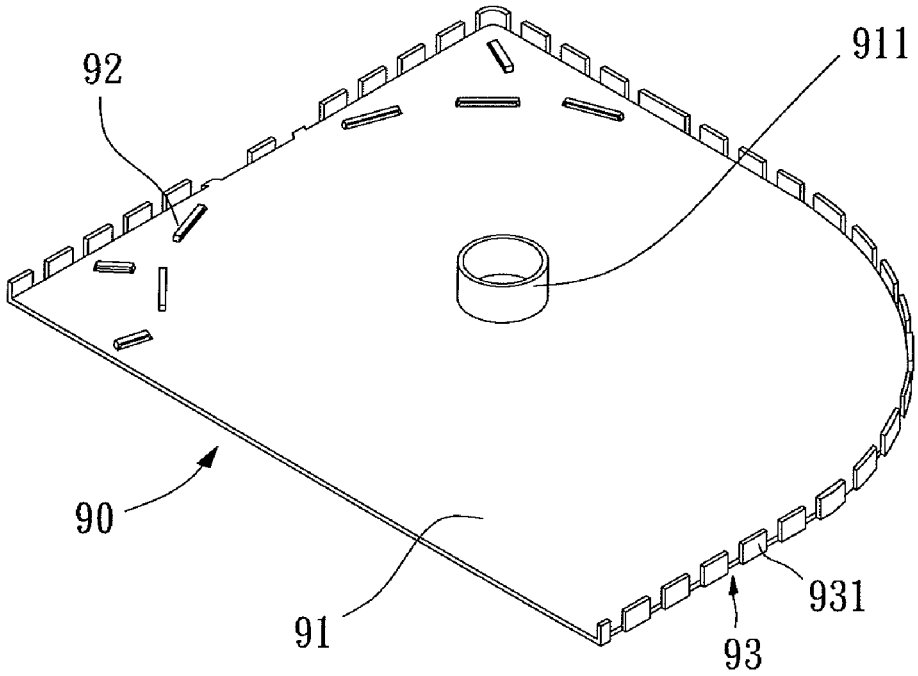
FIG. 11 shows a metal fixing frame of the fan frame structure of FIG. 10.
Figure 12:
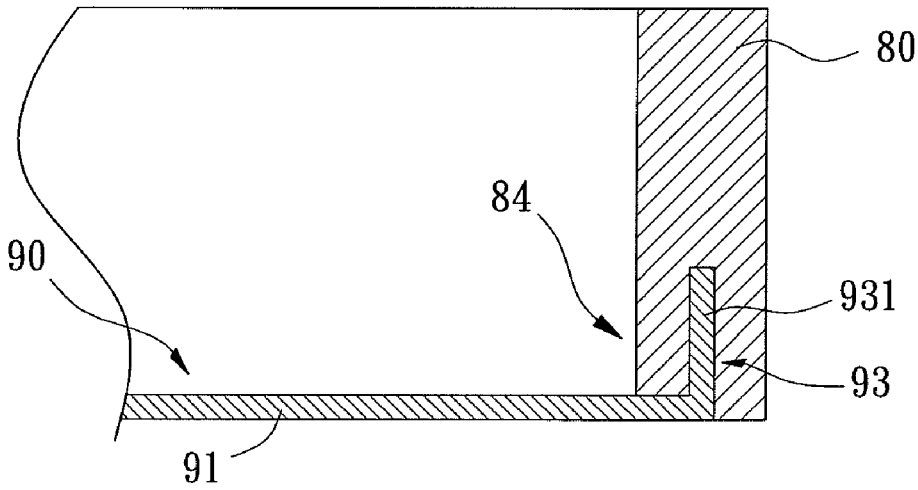
FIG. 12 shows a partial, cross sectional view of the fan frame structure of FIG. 10.

FIGS. 10-12 show a fan frame structure of a fourth embodiment according to the preferred teachings of the present invention. In the preferred form shown, the fan frame structure is for a blower fan and includes a plastic casing 80 and a metal fixing frame 90. In the preferred form shown, the plastic casing 80 includes an air inlet 81 in a top side thereof and an air outlet 82 in a lateral side thereof perpendicular to the top side. The plastic casing 80 defines an accommodation space 83 in communication with the air inlet 81 and the air outlet 82. The bottom side of the plastic casing 80 includes a peripheral edge having a plurality of first fixing portions 84. In the most preferred form shown, the plastic casing 80 is formed by injection molding to form the first fixing portions 84 enveloping predetermined portions of the metal fixing frame 90.

According to the preferred form shown, the metal fixing frame 90 includes a base 91 having a shaft tube seat 911 in a center thereof. The base 91 further includes a plurality of protrusions 92 surrounding the shaft tube seat 911. The base 91 further includes a perimeter having a plurality of second fixing portions 93 for engaging with the first fixing portions 84 of the plastic casing 80, so that the plastic casing 80 and the metal fixing frame 90 can be fixed together. In the most preferred form shown, the second fixing portions 93 include a plurality of tabs 931 extending in an axial direction and spaced from each other along the perimeter of the base 91.

Figure 13:
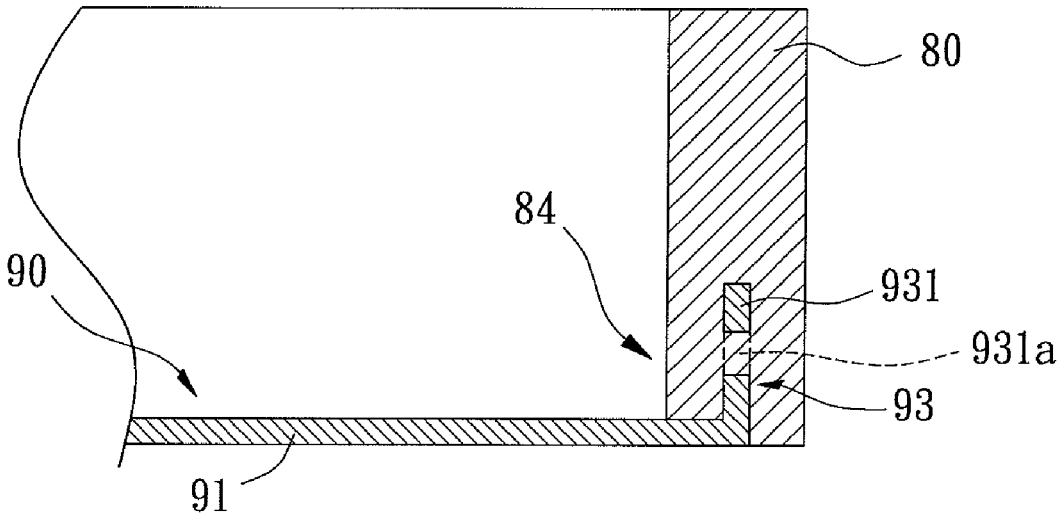
FIG. 13 shows a partial, cross sectional view of an example modified from the fan frame structure of FIG. 10.
Figure 14:
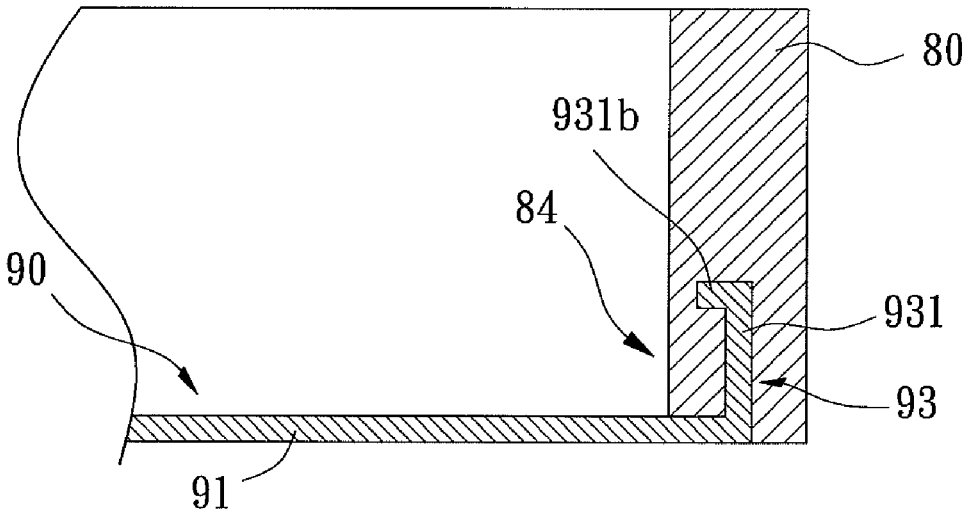
FIG. 14 shows a partial, cross sectional view of another example modified from the fan frame structure of FIG. 10.

In manufacture, the metal fixing frame 90 is placed in a cavity of a mold, and molten plastic material is then poured into the cavity to form the plastic casing 80, so that the second fixing portions 93 can be enveloped by the first fixing portions 84 of the plastic casing 80. Thus, the plastic casing 80 can securely engage with the metal fixing frame 90 without the risk of disengagement by provision of the tabs 931. Each tab 931 can include a positioning hole 931*a* (FIG. 13) or a hooked portion 931*b* (FIG. 14) to enhance the engaging reliability between the plastic casing 80 and the metal fixing frame 90. The plastic material of the plastic casing 80 also bonds with the protrusions 92 to further enhance the bonding strength between the plastic casing 80 and the metal fixing frame 90. A fan frame structure made of different materials for a blower fan is, thus, provided.

It is appreciated that the fasteners 34 utilized in the first embodiment can also be utilized in the second, third, and fourth embodiments if desired. However, when using injection molding to engage the plastic casing 20, 40, 60, 80 with the metal fixing frame 30, 50, 70, 90, some advantages are obtained. These advantages include but are not limited to fewer number of elements, enhanced engaging reliability, and convenient assembly. It is further appreciated that the insulating plate 54 can be utilized in the third and fourth embodiments.

Compared to conventional fan frame structures, the fan frame structure according to the preferred teachings of the present invention includes many advantages. Firstly, since the casing 20, 40, 60, 80 of the fan frame structure according to the present invention is made of inexpensive plastic material, the manufacturing costs are cut. Furthermore, the metal fixing frame 30, 50, 70, 90 provides sufficient structural strength and desired heat dissipating effect. When a fan motor is mounted to the fan frame structure according to the preferred teachings of the present invention, the operational stability and the product quality are enhanced. Secondly, the plastic casing 20, 40, 60, 80 of a single specification can be coupled with a desired metal fixing frame 30, 50, 70, 90 according to the power of the fan motor required. Namely, a single mold is sufficient for various plastic casings for differing fan frame structures having various specifications. New molds or modifications to the molds of the plastic casing 20, 40, 60, 80 is not required. Thirdly, inventory management is simpler and easier, for the products in inventory have fewer types, and the required warehouse or inventory space is smaller. Fourthly, the product quality is improved, for the support arms 32, 52 of the fan frame structure according to the preferred teachings of the present invention are made of metal. Thus, the disadvantages of conventional fan frame structures integrally formed of metal by die casting or of plastic material by injection molding are avoided.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A fan frame structure comprising:

a plastic casing including an air inlet in a top side thereof and an air outlet in a bottom side thereof, with the plastic casing further including an accommodation space in communication with the air inlet and the air outlet, with the bottom side of the plastic casing further including a plurality of corners each having a first fixing portion; and a metal fixing frame including a base having a shaft tube seat in a center thereof, with the base further including a plurality of support arms extending outward from an outer periphery thereof, with each of the plurality of support arms having a first end interconnected to the base and a second end forming an assembling hole and a second fixing portion engaged with one of the first fixing portions of the plastic casing, wherein the assembling hole forms two annular openings on two end faces of the second end respectively, with one of the second fixing portions of the metal fixing frame including a plurality of trenches formed on at least one of the two end faces and circumferentially surrounding at least one of the two annular openings of the assembling hole, with each of the first fixing portions of the plastic casing enveloping the two end faces of one of the second fixing portions of the metal fixing frame by injection molding.

2. The fan frame structure as claimed in claim 1, with each first fixing portion further including a groove, with the groove including a bottom wall having the hole, and with the second end of each of the plurality of support arms being received in one of the grooves.

3. The fan frame structure as claimed in claim 1, with each of the second fixing portions of the metal fixing frame including a slot.

4. The fan frame structure as claimed in claim 1, with each of the second fixing portions of the metal fixing frame including a plurality of ribs.

5. The fan frame structure as claimed in claim 1, further comprising an insulating plate surrounding the shaft tube seat of the base of the metal fixing frame.

6. The fan frame structure as claimed in claim 1, with the plurality of trenches formed on both of the two end faces and circumferentially surrounding both of the two annular openings of the assembly hole.

7. The fan frame structure as claimed in claim 6, with the plurality of trenches formed on both of the two end faces being spaced from each other.

8. A fan frame structure comprising: a plastic casing including an air inlet in a top side thereof and an air outlet in a lateral side thereof, with the plastic casing further including an accommodation space in communication with the air inlet and an air outlet, with the plastic casing further including a bottom side having a peripheral edge with a plurality of first fixing portions; and a metal fixing frame including a base having a shaft tube seat in a center thereof, with the base further including a perimeter having a plurality of second fixing portions each securely engaged with one of the plurality of first fixing portions of the plastic casing.

9. The fan frame structure as claimed in claim 8, with the with each of the first fixing portions of the plastic casing enveloping one of the second fixing portions of the metal fixing frame by injection molding.

10. The fan frame structure as claimed in claim 9, with the plurality of second fixing portions of the metal fixing frame including a plurality of notches in the perimeter of the base.

11. The fan frame structure as claimed in claim 8, further comprising an insulating plate surrounding the shaft tube seat of the base of the metal fixing frame.

12. The fan frame structure as claimed in claim 8, with the base of the metal fixing frame further including a plurality of protrusions surrounding the shaft tube seat, and with the plastic casing enveloping the plurality of protrusions.

13. The fan frame structure as claimed in claim 9, with the plurality of second fixing portions of the metal fixing frame including a plurality of tabs extending in an axial direction and spaced from each other along the perimeter of the base.

14. The fan frame structure as claimed in claim 13, with each of the plurality of tabs including a positioning hole.

15. The fan frame structure as claimed in claim 13, with each of the plurality of tabs including a hooked portion.

* * * * *